United States Patent [19]

Noguchi et al.

[11] Patent Number: 4,895,122

[45] Date of Patent: Jan. 23, 1990

[54] AIR-FUEL RATIO FEEDBACK CONTROL METHOD FOR INTERNAL COMBUSTION ENGINES

[75] Inventors: Kunio Noguchi; Masayuki Ueno, both of Wako, Japan

[73] Assignee: Honda Giken Kogyo K.K., Tokyo, Japan

[21] Appl. No.: 228,009

[22] Filed: Aug. 3, 1988

[30] Foreign Application Priority Data

Aug. 17, 1987 [JP] Japan ..... 62-203680

[51] Int. Cl.[4] ..... F02D 41/14

[52] U.S. Cl. ..... 123/489; 123/478

[58] Field of Search ..... 123/440, 489, 478, 492

[56] References Cited

U.S. PATENT DOCUMENTS

| | | | |
|---|---|---|---|
| 4,612,904 | 9/1986 | Tadokoro et al. | 123/492 |
| 4,744,345 | 5/1988 | Yamato | 123/489 |
| 4,751,906 | 6/1988 | Yatabe et al. | 123/489 |

*Primary Examiner*—Tony M. Argenbright
*Attorney, Agent, or Firm*—Arthur L. Lessler

[57] ABSTRACT

A method of controlling in a feedback manner the air-fuel ratio of an air-fuel mixture supplied to an internal combustion engine having a first fuel injection valve and a second fuel injection valve each operating in a different operating region, during operation of the engine in an air-fuel ratio feedback control region, by the use of a coefficient which varies with the output of an exhaust gas ingredient concentration sensor. In a first and a second operating regions within the air-fuel ratio feedback control region in which the first and second fuel injection valves operate, respectively, a first average value and a second average value of values of said coefficient obtained in the respective regions are calculated, and stored, respectively. When the engine has shifted to the first or and second operating regions, a value based on the corresponding first or second average value is used as an initial value of the coefficient to therely start the feedback control. Preferably, in a third operating region defined as a predetermined period of time which elapses after the engine has shifted from the second operating region to the first operating region, a third average value of values of the coefficient obtained in the third operating region is calculated and stored, and when the engine shifted to the third operating region, the third average value is used as an initial value of the coefficient to thereby start the feedback control.

7 Claims, 7 Drawing Sheets

| FIG. 4A | FIG. 4B |
|---|---|

AIR-FUEL RATIO FEEDBACK CONTROL METHOD FOR INTERNAL COMBUSTION ENGINES

BACKGROUND OF THE INVENTION

The present invention relates to an air-fuel ratio feedback control method for internal combustion engines, and more particularly to an air-fuel ratio feedback control method for an internal combustion engine provided with a plurality of fuel injection valves operating in respective different operating regions of the engine.

An air-fuel ratio feedback control method for internal combustion engines has been proposed by the present applicant, e.g. in Japanese Provisional Patent Publication (Kokai) No. 62-157252, in which during operation of the engine in an air-fuel ratio feedback control region, the air-fuel ratio of an air-fuel mixture supplied to the engine is controlled by the use of a coefficient which varies with change in the output of an exhaust gas ingredient concentration sensor arranged in the exhaust system of the engine.

This proposed control method is characterized by determining in which of a feedback control region and an operating region other than the feedback control region the engine is operating; when the engine is operating in the feedback control region, determining in which of an idling region, an operating region other than the idling region, and a predetermined acceleration operating region and engine is operating; when the engine is operation in the idling region, the operating region other than the idling region, or the predetermined acceleration operating region, an average value of values of the coefficient obtained in each region is calculated and stored for use in each region; when the engine has shifted to one of these operating regions within the feedback control region, the average value stored for the one region to which the engine has shifted is used as an initial value of the coefficient to thereby start the air-fuel ratio feedback control. Thus, the coefficient can be set to a proper initial value at the start of the feedback control, whereby the accuracy of the feedback control is improved.

However, the proposed control method has the drawback that when the method is applied to an internal combustion engine of a type in which fuel is supplied thereto through a plurality of fuel injection valves arranged in an intake pipe at respective different locations and operating in respective different operating regions of the engine, satisfactory accuracy of the feedback control cannot be secured.

More specifically, this type of engine is so constructed that a plurality of fuel injection valves operate in respective different operating regions. Therefore, the fuel injection valves have different injection flow rate characteristics. Further, the fuel injection valves are provided in the intake pipe at different locations, e.g., at a location upstream of a throttle valve and a location downstream of same. Therefore, if the above-described conventional control method is applied to this type of engine, when the engine has shifted from one operating region in which one fuel injection valve is to operate to another operating region in which another fuel injection valve is to operate, the air-fuel ratio is varied due to difference in the locations from which fuel is injected. For example, when the engine has shifted from an operating region of a fuel injection valve located downstream of the throttle valve to an operating region of a fuel injection valve located upstream of same, fuel injected from the fuel injection valve located upstream of the throttle valve, which is farther from cylinders, does not immediately reach the cylinders, and further, part of the injected fuel adheres to the throttle valve and the interior wall of the intake pipe, so that the air-fuel ratio is leaned temporarily immediately after the transition of operating region. Therefore, the responsiveness of the engine to transition from an operating region of one fuel injection valve to an operating region of another fuel injection valve is not satisfactory, resulting in the degraded accuracy of the feedback control.

SUMMARY OF THE INVENTION

It is the object of the invention to provide an air-fuel ratio feedback control method for an internal combustion engine having a plurality of fuel injection valves operating in respective different operating regions which is capable of improving the responsiveness of the engine to transition from an operating region of one fuel injection valve to an operating region of another fuel injection valve, thereby making it possible to improve the accuracy of the feedback control.

To attain the above object, the present invention provides a method of controlling in a feedback manner the air-fuel ratio of an air-fuel mixture being supplied to an internal combustion engine having an intake system, at least one first fuel injection valve and at least one second fuel injection valve both arranged in the intake system for operating in respective operating regions of the engine, the operating regions including an air-fuel ratio feedback control region, an exhaust system, and sensor means arranged in the exhaust system for sensing the concentration of an exhaust gas ingredient therein, wherein during operation of the engine in the air-fuel ratio feedback control region, the air-fuel ratio is controlled by the use of a coefficient which has an initial value and varies with change in the output of the sensor means.

The method according to the invention is characterized by comprising the steps of (a) determining whether or not the engine is operating in a first operating region falling within the feedback control region, in which the first fuel injection valve is to operate;

(b) determining whether or not the engine is operating in a second operating region falling within the feedback control region, in which the second fuel injection valve is to operate;

(c) calculating an average value of values of the coefficient obtained during past operation of the engine in the first operating region, and storing the resulting average value as a first average value, when it is determined that the engine is operating in the first operating region;

(d) calculating an average value of values of the coefficient obtained during past operation of the engine in the second operating region, and storing the resulting average value as a second average value, when it is determined that the engine is operating in the second operating region, (e) setting the initial value of the coefficient to a value based on the first average value to thereby start the feedback control of the air-fuel ratio, when the engine has shifted to the first operating region; and (f) setting the initial value of the coefficient to a value based on the second average value to thereby start the feedback control of the air-fuel ratio, when the engine has shifted to the second operating region.

Preferably, the method according to the invention may further comprise the steps of:

(g) determining whether or not the engine is operating in a third operating region which is defined as a period of time which elapse after the engine has shifted from the second operating region to the first operating region;

(h) calculating an average value of values of the coefficient obtained during past operation of the engine in the third operating region, and storing the resulting average value as a third average value, when it is determined that the engine is operating in the third operating region; and (i) setting the initial value of the coefficient to a value based on the third average value to thereby start the feedback control of the air fuel ratio, when the engine has shifted to the third operating region.

The second operating region is an idling region which is part of the air-fuel ratio feedback control region, and the first operating region forms part of the air-fuel ratio feedback control region other than the idling region.

The intake system has an intake pipe and a throttle valve arranged in the intake pipe, the first fuel injection valve being arranged in the intake pipe at a location upstream of the throttle valve, and the second fuel injection valve being arranged in the intake pipe at a location downstream of the throttle valve.

Preferably, at the step (f), the initial value of the coefficient is set to the product of the second average value and a predetermined coefficient.

The above and other objects, features and advantages of the invention will become more apparent from the ensuing detailed description taken in conjunction with the accompanying drawings.

DETAILED DESCRIPTION

The method according to the present invention will now be described with reference to the drawings showing an embodiment thereof.

Figure 1:
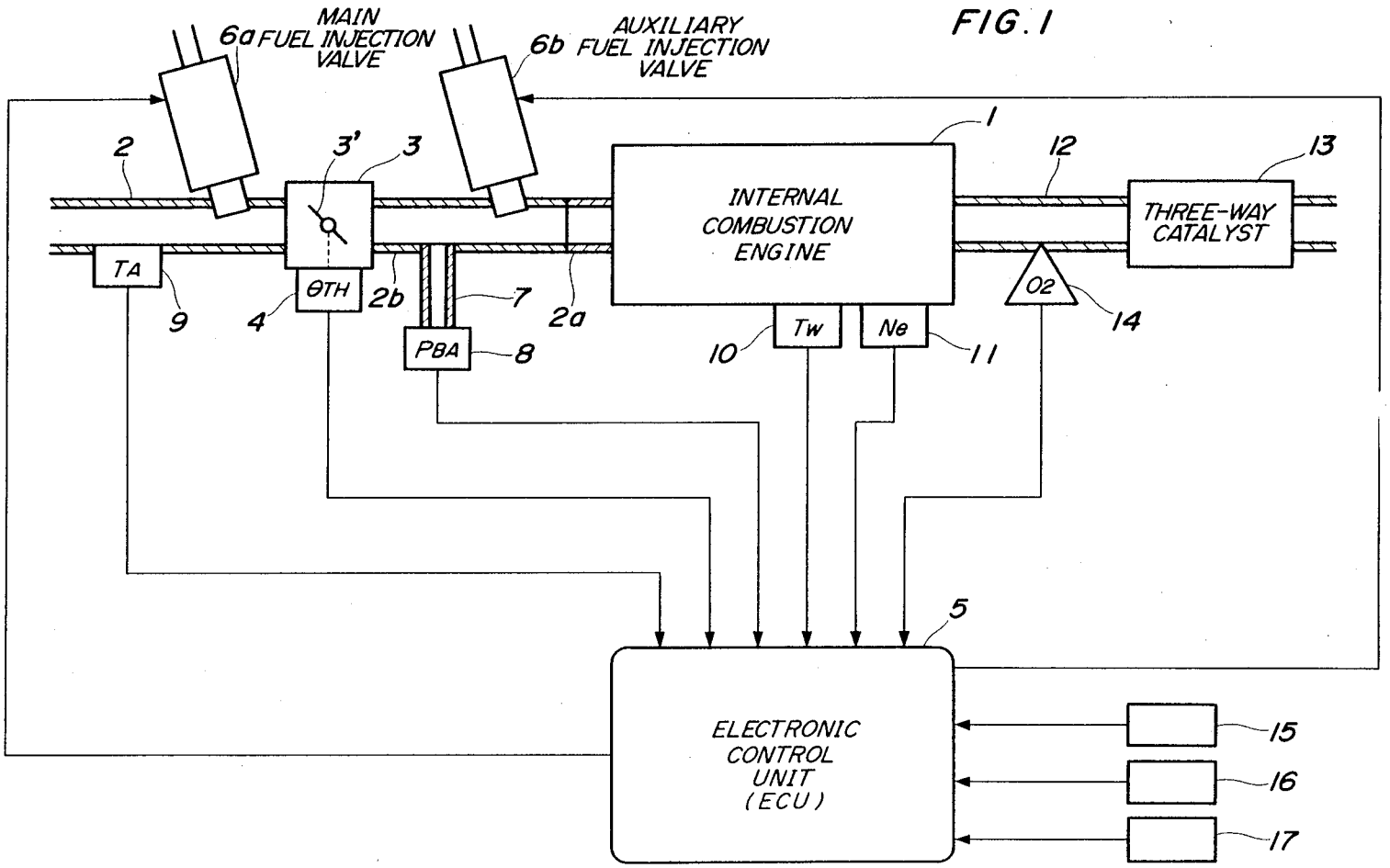
FIG. 1 is a block diagram illustrating the whole arrangement of a fuel supply control system to which is applied the air-fuel ratio feedback control method according to the invention.

Referring first to FIG. 1, there is illustrated the whole arrangement of a fuel supply control system for an internal combustion engine, to which the method according to the present invention is applied. Reference numeral 1 designates an internal combustion engine which may be a four-cylinder type, for instance. Connected to the engine 1 is an intake pipe 2 which comprises a diversified portion **2*a* comprising diverse pipes connected to respective cylinders and a united portion 2*b* where the diverse pipes are united. In the united portion 2*b* of the intake pipe 2, there is provided a throttle body 3, in which is arranged a throttle valve 3', to which is connected a throttle valve opening ($\theta$th) sensor (hereinafter referred to as "$\theta$th sensor") 4 for detecting the valve opening ($\theta$th) of the throttle valve 3' and converting same into an electrical signal which is supplied to an electronic control unit (hereinafter referred to as "the ECU") 5**.

A main fuel injection valve (a first fuel injection valve) **6*a* is arranged in the united portion 2*b* of the intake pipe 2 at a location upstream of the throttle body 3. The main fuel injection valve 6*a* supplies fuel to all the cylinders of the engine 1 during operation other than idling operation of the engine 1**.

On the other hand, an auxiliary fuel injection valve (a second fuel injection valve) **6*b* is arranged in the united portion 2*b* of the intake pipe 2 at a location downstream of the throttle body 3. The auxiliary fuel injection valve 6*b* supplies fuel to all the cylinders of the engine 1** during idling operation of the engine under a fully warmed-up condition.

An absolute pressure ($P_{BA}$) sensor (hereinafter referred to as "the $P_{BA}$ sensor") 8 communicates through a conduit 7 with the interior of the intake pipe 2 at a location downstream of the throttle valve 3. The $P_{BA}$ sensor 8 detects absolute pressure in the intake pipe 2 and supplies an electrical signal indicative of the detected absolute pressure to the ECU 5. An intake air temperature (hereinafter referred to as "the $T_A$ sensor") 9 is provided at a location upstream of the main fuel injection valve **6*a* for supplying the ECU 5** with an electric signal indicative of the detected engine intake air temperature.

An engine coolant temperature ($T_W$) sensor 10, which may be formed of a thermistor or the like, is mounted in the cylinder block of the engine 1 in a manner embedded in the peripheral wall of an engine cylinder having its interior filled with coolant, detects engine coolant temperature ($T_W$) and supplies an electrical signal indicative of the detected engine coolant temperature to the ECU 5. An engine rotational angle position sensor (hereinafter referred to as "the Ne sensor") 11 is arranged in facing relation to a camshaft, not shown, of the engine 1 or a crankshaft of same, not shown. The Ne sensor is adapted to generate a pulse of a top-dead-center position (TDC) signal (hereinafter referred to as "the TDC signal") at one of particular crank angles of the engine, i.e. at a crank angle position of each cylinder which comes a predetermined crank angle earlier relative to the top-dead-center position (TDC) at which the suction stroke thereof starts, whenever the engine crankshaft rotates through 180 degrees. The pulse generated by the Ne sensor is supplied to the ECU 5.

A three-way catalyst 13 is arranged in an exhaust pipe 2 extending from the cylinder block of the engine 1 for purifying ingredients HC, CO and NOx contained in the exhaust gases. An $O_2$ sensor 14 as sensor means for sensing the concentration of an exhaust gas ingredient is inserted in the exhaust pipe 12 at a location upstream of the three-way catalyst 13 for detecting the concentration of oxygen ($O_2$) in the exhaust gases and supplying an electrical signal indicative of the detected oxygen concentration to the ECU 5. Further connected to the ECU 5 are an atmospheric pressure sensor 15 for detecting atmospheric pressure and an engine starter switch 16, respectively for supplying an electrical signal indicative of the detected atmpospheric pressure and an electrical signal indicative of its own on and off positions to the ECU 5.

Also, battery 17 is connected to the ECU 5 for supplying the latter with operating voltage.

The ECU 5 operates in response to various engine operating parameter signals stated above, to determine operating conditions or operating regions in which the engine is operating, such as an air-fuel ratio feedback control region and an open loop control region, and then to calculate the fuel injection periods $T_{OUTM}$ and $T_{OUTAUX}$ for which the main fuel injection valve 6a and the auxiliary fuel injection valve 6b should be opened, respectively, in accordance with the determined operating conditions or regions of the engine and in synchronism with generation of pulses of the TDC signal, by the use of the following equations (1) and (2).

$$T_{OUTM}=T_{iM}\times K_{O2}\times K_1+K_2 \quad (1)$$

$$T_{OUTAUX}=T_{iAUX}\times K_{O2}\times K_1K_2 \quad (2)$$

where $T_{iM}$ represents a basic value of the valve opening period for the main fuel injection valve 6a, and $T_{iAUX}$ represents a basic value of the valve opening period for the auxiliary fuel injection valve 6b, each being determined from the engine rotational speed Ne and the intake pipe absolute pressure $P_{BA}$. $K_{O2}$ is an $O_2$ feedback correction coefficient which is calculated in accordance with a program (FIG. 4) of the present invention stated below. $K_1$ and $K_2$ are correction coefficients and correction variables, respecively, and are calculated based on various engine parameter signals to such values as optimize engine characteristics, such as fuel consumption and engine accelerability.

The ECU 5 supplies driving signals to the main fuel injection valve 6a and the auxiliary fuel injection valve 6b to open the valves over the respective fuel injection periods $T_{OUTM}$ and $T_{OUTAUX}$.

Figure 2:
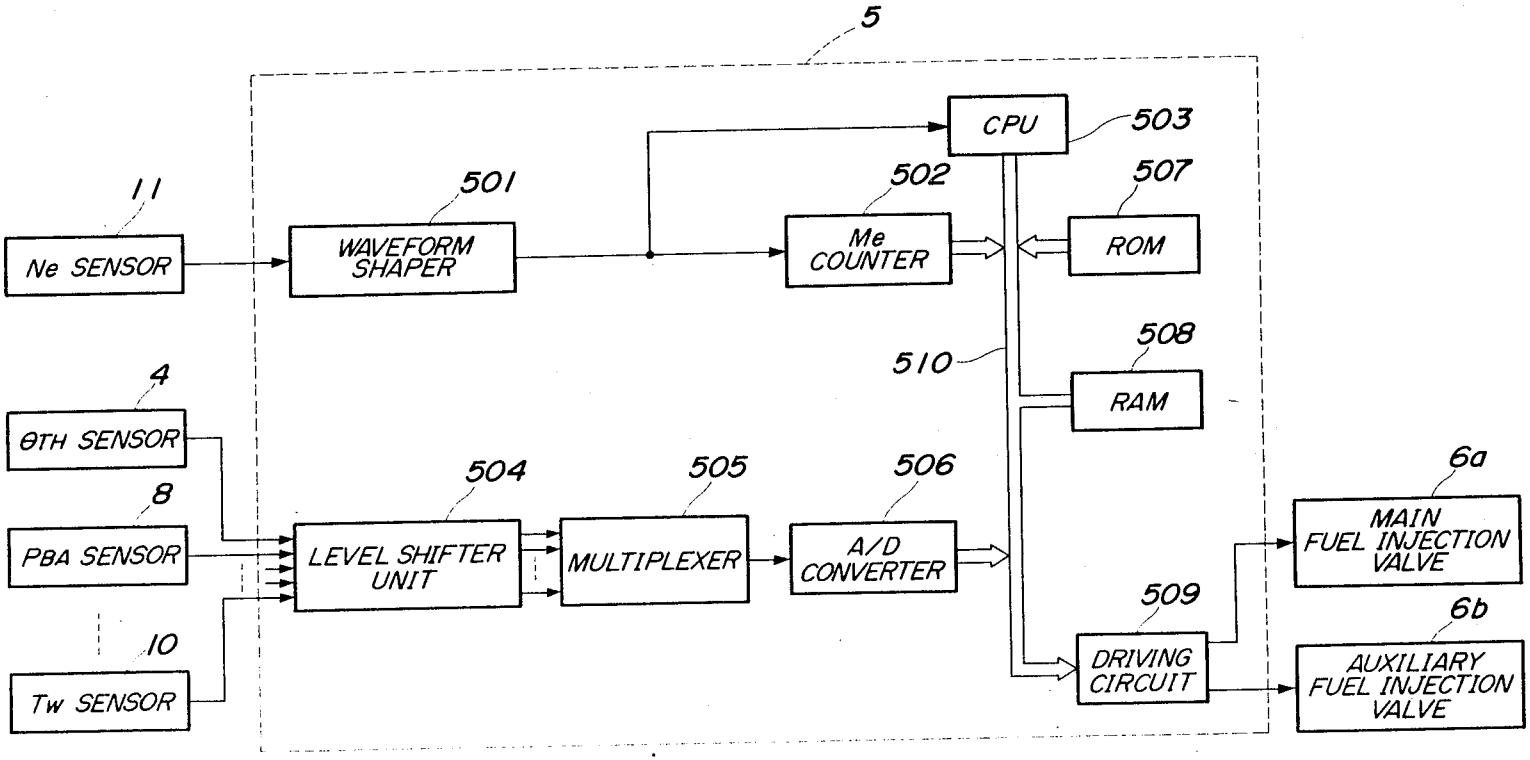
FIG. 2 is a block diagram illustrating the internal arrangement of an electronic control unit (ECU) appearing in FIG. 1.

FIG. 2 shows a circuit configuration within the ECU 5 in FIG. 1. An output signal from the Ne sensor 11 is supplied to a waveform shaper 501, wherein it has its pulse waveform shaped, and the shaped signal is supplied to a central processing unit (hereinafter referred to as "the CPU") 503, as well as to an Me value counter 502, as the TDC signal. The Me value counter 502 counts the interval of time between an immediately preceding pulse of the TDC signal and a present pulse of the same signal, which are inputted to the ECU 5 from the Ne sensor 11, and therefore its counted value Me corresponds to the reciprocal of the actual engine rotational speed Ne. The Me value counter 502 supplies the counted value Me to the CPU 503 via a data bus 510.

Respective output signals from the $\theta_{th}$ sensor 4, $P_{BA}$ sensor 8, $T_W$ sensor 10, etc. shown in FIG. 1 have their voltage levels shifted to a predetermined voltage level by a level shifter unit 504 and the level-shifted signals are successively supplied to an analog-to-digital (A/D) converter 506 through a multiplexer 505 to be successively converted into digital signals. The digital signals are supplied to the CPU 503 via the data bus 510.

Further connected to the CPU 503 via the data bus 510 are a read-only memory (hereinafter referred to as "the ROM") 507, a random access memory (hereinafter referred to as "the RAM") 508, and a driving circuit 509. The RAM 508 temporarily stores various calculated values from the CPU 503, while the ROM 507 stores control programs executed within the CPU 503, a $T_{iM}$ map and a $T_{IAUX}$ map from which an appropriate value of basic fuel injection period $T_{iM}$ for the main fuel injection valve 6a and an appropriate value of basic fuel injection period $T_{iAUX}$ for the auxiliary fuel injection valve 6b are respectively read in accordance with the engine rotational speed Ne and the intake pipe absolute pressure $P_{BA}$, maps from which predetermined value of respective correction coefficients are read, etc.

The CPU 503 executes a control program stored in the ROM 507 to calculate the fuel injection period $T_{OUTM}$ for the main fuel injection valve 6a or the fuel injection valve 6b in response to the various engine parameter signals, and supplies the calculated value of each fuel injection period to the driving circuit 509 through the data bus 510. The driving circuit 509 supplies a driving signal corresponding to the above calculated $T_{OUTM}$ value or $T_{OUTAUX}$ value to the corresponding main fuel injection valve 6a or auxiliarly fuel injection valve 6b to drive each valve.

Figure 3:
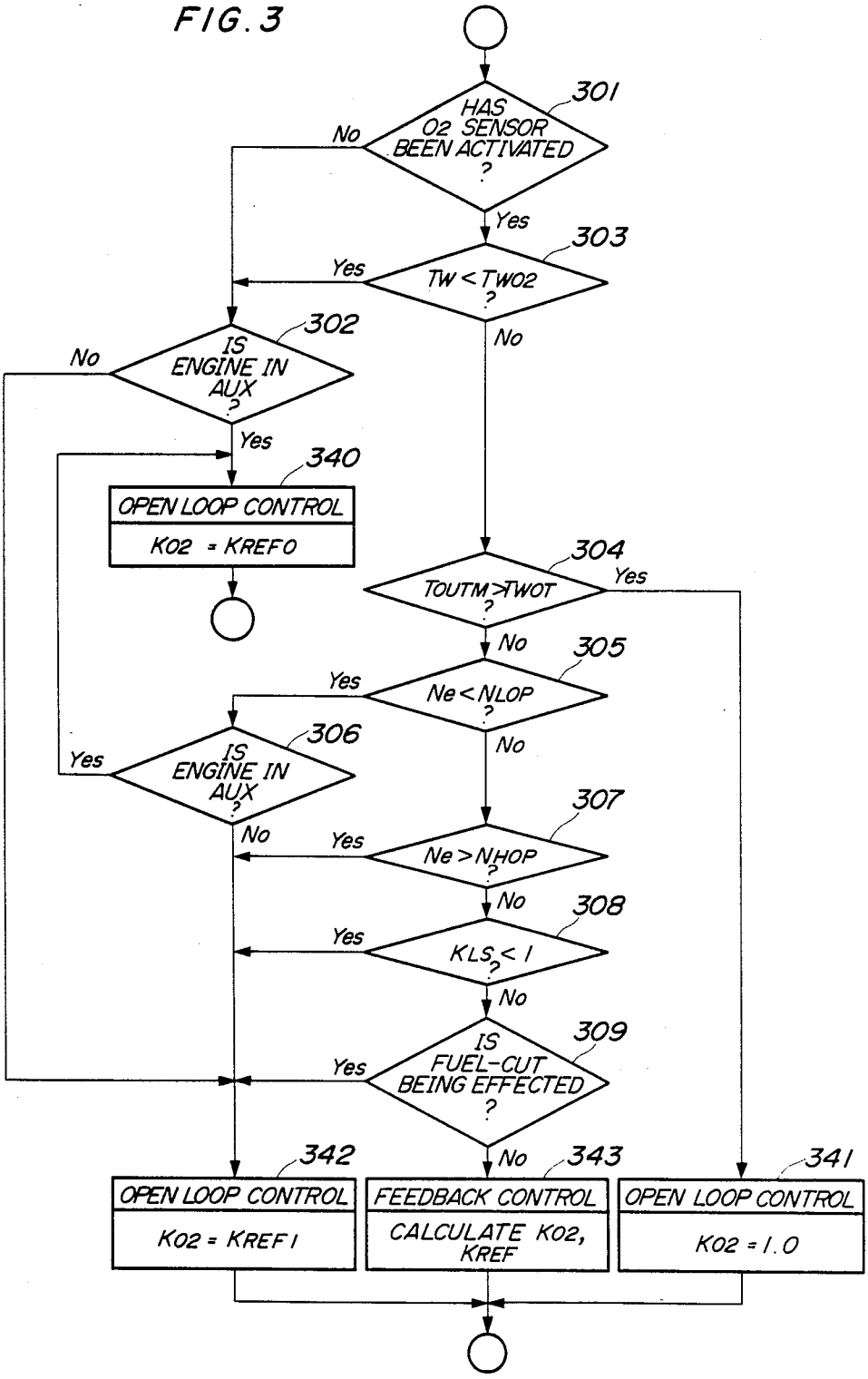
FIG. 3 is a flowchart showing a manner of executing the method according to the invention.

FIG. 3 shows the control program for carrying out the control method according to the invention, which is executed upon generation of each TDC signal pulse.

Figure 5:
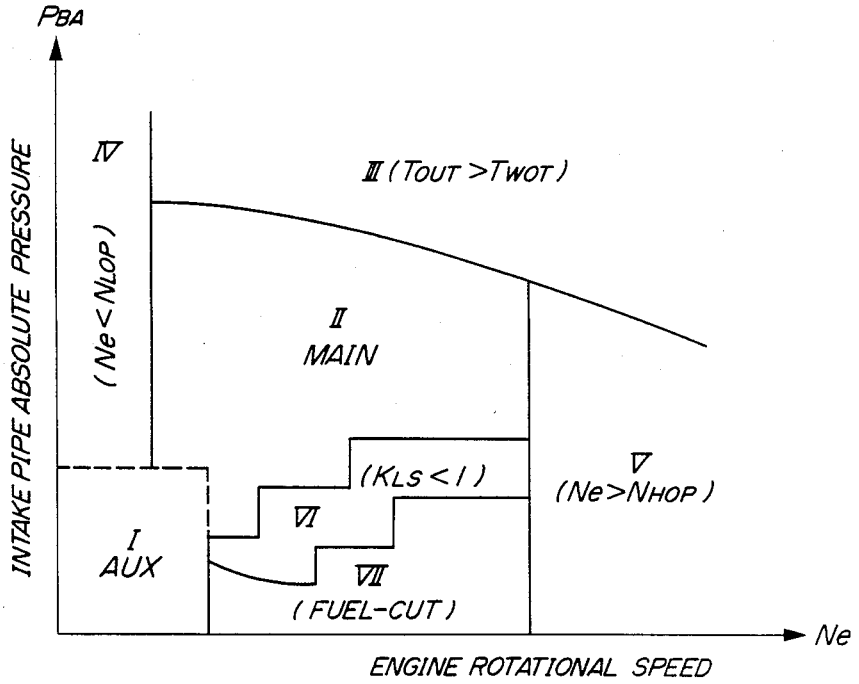
FIG. 5 is a graph showing various operating regions of the engine.

First, it is determined at step 301 whether or not the $O_2$ sensor 14 has become activated. If the answer is No, that is, if the $O_2$ sensor 14 has not yet been activated, then it is determined at step 302 whether or not the engine is operating in an idling region I, part of the feedback control region and indicated by the symbol I in FIG. 5, in which the auxiliary fuel injection valve 6b is to operate (region AUX). This determination is carried out, as shown in FIG. 5, by determining whether or not the engine rotational speed Ne is below a predetermined value and at the same time the intake pipe absolute pressure $P_{BA}$ is below a predetermined value.

If the answer to the question at step 302 is Yes, the $O_2$ feedback correction coefficient $K_{O2}$ has its value set to an average value $K_{REFO}$ (a second average value), which has been calculated during preceding feedback control effected in the operating region of the auxiliary fuel injection valve 6b in a manner hereinafter described in detail, and open loop control is executed (step 340). If the answer to the question at step 302 is No, the correction coefficient $K_{O2}$ has its value set to an average value $K_{REF1}$ (a first average value), which has been calculated during preceding feedback control effected in an operating region of the main fuel injection valve 6a, part of the feedback control region and indicated by the symbol II in FIG. 5 (region MAIN), and open loop control is executed (step 342).

If the answer to the question at step 301 is Yes, that is, if the $O_2$ sensor 14 has been activated, a determination is made as to whether or not the engine coolant temperature $T_W$ is lower than a predetermined value $T_{WO2}$ (step 303), to determine whether the engine is operating in an operating condition where feedback control responsive to the output signal from the $O_2$ sensor 14 should be effected. If the answer to the question at step 303 is Yes, the program proceeds to the aforementioned step 302, while if the answer is No, the program proceeds to step 304.

The ground for providing the step 303 is that when the temperature $T_W$ of the engine coolant is lower than the above predetermined value $T_{WO2}$, the air-fuel ratio of the mixture should not be controlled in feedback mode even with the $O_2$ sensor activated, but should be controlled in open loop mode so as to promptly warm up the engine.

At step 304, it is determined whether or not the fuel injection period $T_{OUTM}$ of the main fuel injection valve 6a is longer than a predetermined time period $T_{WOT}$. This determination is made to determine whether or not the engine is operating in a wide-open-throttle region (region III in FIG. 5). If the answer is Yes, the program proceeds to step 341 to set the $O_2$ feedback correction coefficient $K_{O2}$ to a value of 1.0, whereby the air-fuel ratio is controlled in open loop mode with the same coefficient held at 1.0, while if the answer at step 304 is No, it is determined at step 305 whether or not the engine is operating in a low engine speed open loop control region (region IV in FIG. 5), based on whether the engine sped Ne is lower than a predetermined value $N_{LOP}$. If the answer at step 305 is Yes, the program proceeds to step 306 wherein it is determined whether or not the engine is operating in the region AUX, while if the answer at step 305 is No, the program proceeds to step 307.

If the answer at step 306 is Yes, the program proceeds to the aforementioned step 340, while if the answer at step 306 is No, the program proceeds to the aforementioned step 342. At step 307, it is determined whether or not the engine speed Ne is higher than a predetermined value $N_{HOP}$ to thereby decide whether the engine is operating in a high engine speed open loop control region (region V in FIG. 5). If the answer at step 307 is Yes, the program proceeds to the aforementioned step 342, while if the answer is No, it is determined at step 308 whether or not the value of mixture-leaning correction coefficient $K_{LS}$ is smaller than 1.0 (i.e. $K_{LS} < 1.0$), in other words, whether or not the engine is operating in a mixture-leaning region VI in FIG. 5.

If the answer at step 308 is Yes, the aforementioned step 342 is executed, and if No, step 309 is executed to determine whether or not the engine is operating in a fuel-cut region (region VII in FIG. 5). The determination at step 309 is made depending, for example, on whether or not the throttle valve opening $\theta_{TH}$ shows a substantially fully closed position, when the engine speed Ne is lower than a predetermined value NFC, or whether or not the intake pipe absolute pressure $P_{BA}$ is lower than a predetermined value $P_{BAFCj}$ which is set to larger values as the engine speed Ne increases, when the engine speed Ne is higher than the predetermined value NFC.

Figure 4A:
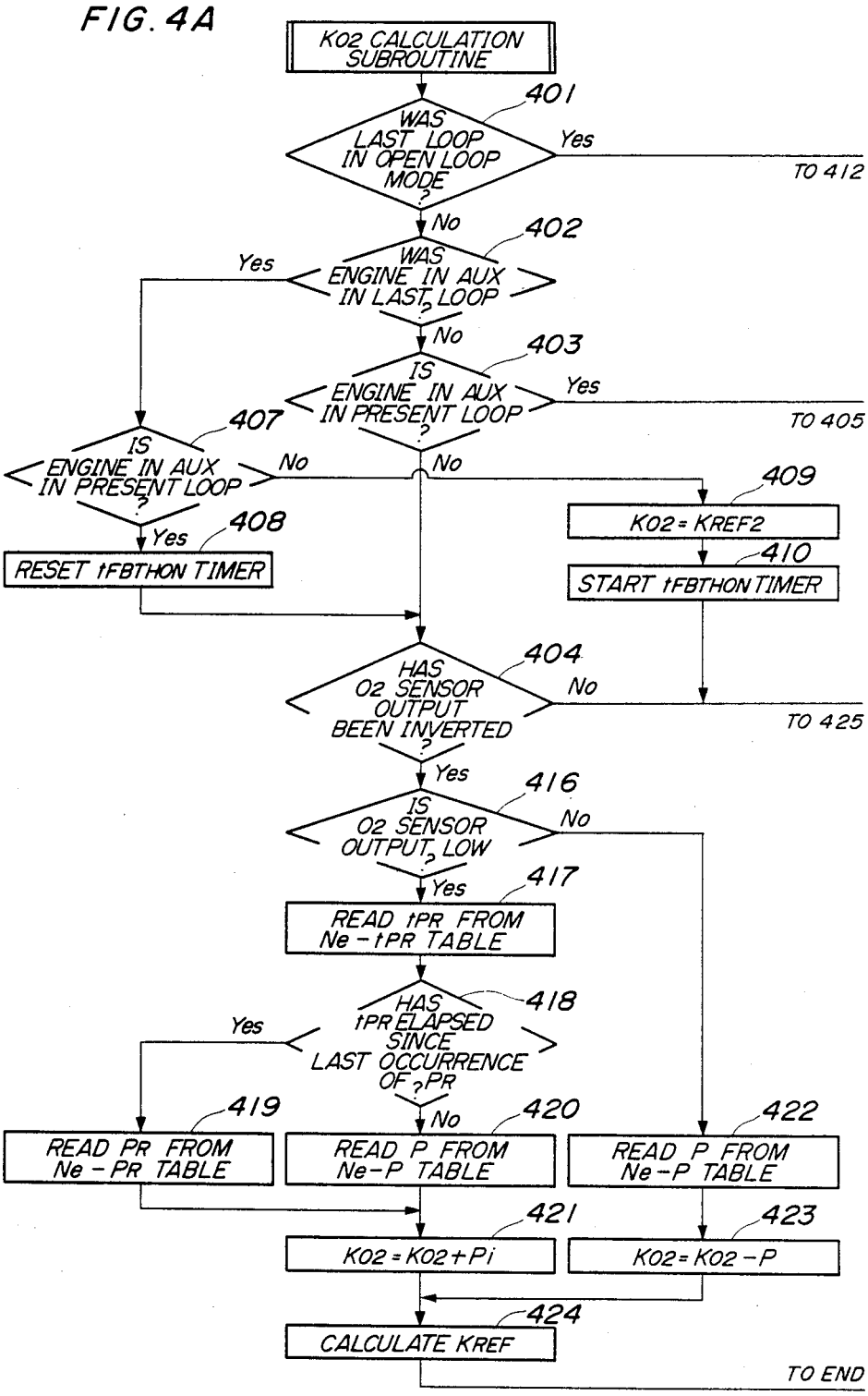
FIGS. 4, 4A and 4B are a flowchart showing in detail a subroutine for calculating the value of a correction coefficient $K_{O2}$ appearing in FIG. 3.
Figures 4, 4B:
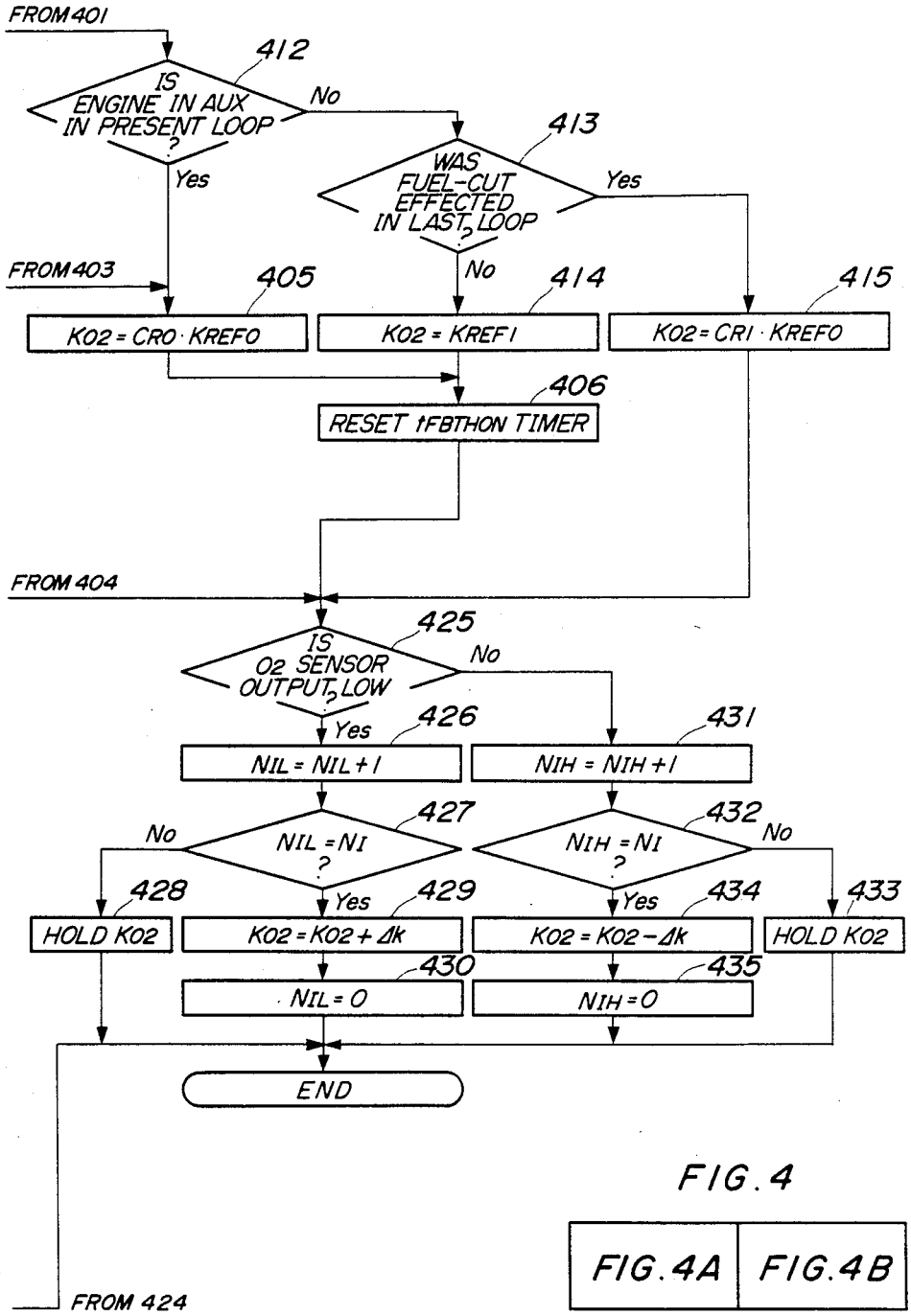

If the determination at step 309 provides an affirmative answer, that is, when the engine is operating in the fuel-cut region, the program proceeds to the aforementioned step 342, and if the answer at step 309 is negative, it is judged that the engine is operating in the feedback control region, i.e., either in region AUX (region I in FIG. 5) or in region MAIN (region II in FIG. 5), whereupon calculations are made of the value of the $O_2$ feedback correction coefficient $K_{O2}$ to be used in the feedback control region and the average value $K_{REF}$ thereof in accordance with the program of FIG. 4 hereinafter explained (step 343). In this way, the engine is determined to be operating in the air-fuel ratio feedback control region when all the determinations at steps 304 through 309 provide negative answers, and then the feedback control is effected.

Calculation of the correction coefficient $K_{O2}$ at step 343 in FIG. 3 is carried out in a manner shown in the flowchart of FIG. 4 upon generation of each TDC signal pulse.

First, it is determined at step 401 whether or not the immediately preceding or last loop, i.e. the loop started upon generation of the immediately preceding pulse of the TDC signal, was executed in open loop mode. If the answer is No, a determination is made at step 402 as to whether or not the engine was operating in the operating region of the auxiliary fuel injection valve 6b (region AUX) in the last loop. If the answer at step 402 is No, it is determined at step 403 whether or not the engine is operating in the operating region of the auxiliary fuel injection valve 6b (region AUX) in the present loop. If the answer at step 403 is No, that is, if the engine was operating in the last loop and is also operating in the present loop in the operating region of the main fuel injection valve 6a, it is determined at step 404 whether or not the output of the $O_2$ sensor 14 has been inverted between the last loop and the present loop.

If the answer at step 403 is Yes, that is, if the present loop is the first loop after the engine has shifted from the operating region of the main fuel injection valve 6a to the correction coefficient $K_{O2}$ has its value set to $C_{RO} \times K_{REF0}$, the product of a predetermined coefficient $C_{RO}$ and the average value $K_{REF0}$ (the second average value) for use in the control in the operating region of the auxiliary fuel injection valve 6b, which has been calculated during preceding feedback control effected in the operating region of the auxiliary fuel injection valve 6b in a manner hereinafter described in detail. This makes it possible to set the correction coefficient $K_{O2}$ to a value suitable for the operating region of the auxiliary fuel injection valve 6b promptly after the engine has shifted from the operating region of the main fuel injection valve 6a to that of the auxiliary fuel injection valve 6b, to thereby improve the responsiveness of the engine to the transition of operating region. Further, it is possible to control emission characteristics by suitably setting the coefficient $C_{RO}$. That is, if the coefficient $C_{RO}$ is set to a value larger than 1.0, the air-fuel mixture is enriched by a degree corresponding to the value of $C_{RO}$, whereby the emission of NOx can be controlled to a smaller value. On the other hand, if the amounts of emission of CO and HC are to be controlled to smaller values, it is only necessary to set the coefficient $C_{RO}$ to a value smaller than 1.0.

After step 405 is executed, a $t_{FBTHON}$ timer which is to be started at step 410 hereinafter described in reset (step 406), and then integral control (I-term control) of the air-fuel ratio is executed at steps 425 et seq.

If the answer at step 402 is Yes, it is determined similarly to the aforementioned step 403 whether or not the engine is operating in the operating region of the auxiliary fuel injection valve 6b (region AUX) in the present loop (step 407). If the answer at step 407 is Yes, that is, if the engine was operating in the last loop and is also operating in the present loop in the operating region of the main fuel injection valve 6b, the $t_{FBTHON}$ timer is reset at step 408 similarly to the aforementioned step 406, and then the aforementioned step 404 is executed.

If the answer at step 407 is No, that is, if the present loop is the first loop after the engine has shifted from the operating region of the auxiliary fuel injection valve 6b to that of the main fuel injection valve 6a, the correction coefficient $k_{O2}$ has its value set to an average value $K_{REF2}$ ( the third average value), which has been calculated, in a manner hereinafter described, during the feedback control effected in the operating region of the main fuel injection valve 6a, within a predetermined period of time after the engine has shifted from the operating region of the auxiliary fuel injection valve 6b to that of the main fuel injection valve 6a (step 409).

Since the main fuel injection valve 6a is arranged upstream of the auxiliary fuel injection valve 6b in the intake pipe 2, the air-fuel mixture tends to be leaned over a certain period of time immediately after the engine shifts from the operating region of the auxiliary fuel injection valve 6b to that of the main fuel injection valve 6a. Therefore, by setting the correction coefficient $K_{O2}$ as described above, the above-mentioned tendency for the mixture to be leaned can be prevented, and the responsiveness of the engine to the transition of operating region can also be enhanced.

After the aforementioned step 409 is executed, the $t_{FBTHON}$ timer is started (step 410), and then the integral control (I-term control) of the air-fuel ratio is executed at steps 425 et seq.

If the answer at step 401 is Yes, that is, if the immediately preceding or last loop was executed in open loop mode, and therefore the present loop is the first loop immediately after the engine has shifted from an open loop control region to the feedback control region, the program proceeds to step 412.

A step 412, similarly to the aforementioned steps 403 and 407, it is determined whether or not the engine is operating in the operating region of the auxiliary fuel injection valve 6b (region AUX) in the present loop. If the answer at step 412 is Yes, that is, if the present loop is the first loop after the engine has shifted from an open loop control region to the operating region of the auxiliary fuel injection valve 6b within the feedback control region, the aforementioned steps 405 and 406 are executed, and then the integral control (I-term control) of the air-fuel ratio is executed at steps 425 et seq.

If the answer at step 412 is No, that is, if the present loop is the first loop after the engine has shifted from an open loop control region to the operating region of the main fuel injection valve 6a within the feedback control region, it is determined at step 413 whether or not the engine was operating in a fuel-cut region in the immediately preceding loop. If the answer at step 413, is No, the correction coefficient $K_{O2}$ has its value set to the average value $K_{REF1}$ for use in the control in the operating region of the main fuel injection valve 6a, which has been calculated during preceding feedback control effected in the operating region of the main fuel injection valve 6a in a manner hereinafter described in detail (step 414).

Then the aforementioned step 406 is executed, followed by execution of the integral control (I-term control) of the air-fuel ratio at steps 425 et seq.

The above control makes it possible to set the correction coefficient $K_{O2}$ to a value suitable for the operating region of the main fuel injection valve 6a promptly after the engine has shifted from an open loop control region to the operating region of the main fuel injection valve 6a within the feedback control region, to thereby improve the responsiveness of the engine to the transition of operating region.

If the answer at step 413 is Yes, the correction coefficient $K_{O2}$ has its value set to $C_{R1} \times K_{REF0}$, the product of an enriching coefficient $C_{R1}$ which has a value larger than 1.0 and the average value $K_{REF0}$ (the second average value) for use in the control in the operating region of the auxiliary fuel injection valve 6b (step 415), and then the integral control (I-term control) of the air-fuel ratio is executed at steps 425 et seq. Immediately after termination of fuel-cut operation, the air-fuel mixture tends to be substantially leaned due to adherence of fuel to the intake pipe 2, etc. Therefore, the air-fuel mixture is enriched by a degree corresponding to the correction coefficient $C_{R1}$, thereby preventing substantial leaning of the mixture.

If the answer at 404 is Yes, that is, if the output of the $O_2$ sensor 14 has been inverted between the last loop and the present loop, proportional control or P-term control of the air-fuel ratio is carried out. That is, it is determined at step 416 whether or not the output level of the $O_2$ sensor is low (LOW). If the answer at step 416 is Yes, a predetermined period of time $t_{PR}$ depending on the engine rotational speed Ne is read from an Ne-$t_{PR}$ table (step 417). The predetermined time period $t_{PR}$ is used for maintaining constant the frequency with which a second correction value $P_R$ described hereinafter is applied, over the whole engine rotational speed range. To this end, it is set to smaller values as the engine rotational speed Ne increases.

Next, it is determined at step 418 whether or not the above-mentioned predetermined period of time $t_{PR}$ has elapsed after the second correction value $P_R$ was applied last time. If the answer at step 418 is Yes, the second correction value $P_R$ depending on the engine rotational speed Ne is read from an Ne-$P_R$ table (step 419), while if the answer at step 418 is No, a first correction value P depending on the engine rotational speed Ne is read from an Ne-P table (step 420). The first correction value P is set to a value smaller than the second correction value $P_R$ at the same engine rotational speed. Then at step 421, a correction value Pi, i.e. the first correction value P or the second correction value $P_R$ read as above, is added to the correction coefficient $K_{O2}$. On the other hand, if the answer at step 416 is No, similarly to the step 420, the correction value P depending on the engine rotational value Ne is read from the Ne-P table (step 422), and at step 423 the correction value P is subtracted from the correction coefficient $K_{O2}$.

Thus, when the output level of the $O_2$ sensor 14 is inverted, the first correction value P or the second correction value $P_R$ depending on the engine rotational speed Ne is added to or subtracted from the correction coefficient $K_{O2}$ so as to correct the latter in a direction reverse to the output level-inverting divertion.

By the use of the value of $K_{O2}$ thus obtained, an average value $K_{REFn}$ of $K_{O2}$ is calculated in accordance with the following equation (3) (step 424), and the average value is stored. The average value $K_{REFn}$ is calculated according to the $K_{REF}$ calculation subroutine described hereinafter with reference to FIG. 6, depending on a feedback control region to which the present loop belongs, as $K_{REF0}$, $K_{REF1}$, or $K_{REF2}$.

$$K_{REFn} = K_{O2P} \times (C_{REFn}/A) + K_{REFn'} \times (A - C_{REFn})/A \quad (3)$$

where $K_{O2P}$ is a value of $K_{O2}$ obtained immediately before or immediately after operation of proportional control or P-term control, A is a constant, $C_{REFn}$ is a variable experimentally set for each feedback control region and having a suitable value ranging from 1 to A, and $K_{REFn'}$, is an average value of $K_{O2}$ obtained up to the immediately preceding loop in a feedback control region to which the present loop belongs.

The ratio of $K_{O2P}$ to $K_{REFn}$ obtained at each P-term control operation depends on the value of the variable $C_{REFn}$. Therefore, it is possible to obtain a most suitable $K_{REFn}$ ($K_{REF0}$, $K_{REF1}$, or $K_{REF2}$) by suitably setting $C_{REFn}$ to a value within the above-mentioned range of 1 to A depending on the characteristics of an air-fuel ratio feedback control system to which the present invention is applied, the engine, etc.

If the answer at step 404 is No, that is if the output level of the $O_2$ sensor 14 has not been inverted, the integral control (I-term control) of the air-fuel ratio is executed at steps 425 et seq. First at step 425, similarly to the above-mentioned step 416, it is determined whether or not the output level of the $O_2$ sensor 14 is low. If the answer at step 425 is Yes, that is, if the output level of the $O_2$ sensor 14 is low, the number of pulses of the TDC signal inputted is counted (step 426), and then it is determined at step 427 whether or not the counted number $N_{IL}$ has reached a predetermined value $N_I$. If the answer at step 427 is No, the correction coefficient $K_{O2}$ is maintained at an immediately preceding value (step 428), while if the answer at step 427 is Yes, a predetermined value $\Delta K$ is added to the correction coefficient $K_{O2}$ (step 429) and the above-mentioned counted number $N_{IL}$ is reset to 0 (step 430), thus adding the predetermined value $\Delta K$ to the $K_{O2}$ each time $N_{IL}$ reaches $N_I$.

If the answer at step 425 is No, the number of pulses of the TDC signal inputted is counted (step 431), and it is determined at step 432 whether or not the counted number $N_{IH}$ has reached a predetermined value $N_I$. If the answer at step 427 is No, the correction coefficient $K_{O2}$ is maintained at an immediately preceding value (step 433).

If the answer at step 432 is Yes, the predetermined value $\Delta k$ is subtracted from the correction coefficient $K_{O2}$ (step 434), and the above-mentioned counted number $N_{IH}$ is reset to 0 (step 435), thus subtracting the predetermined value $\Delta k$ from the correction coefficient $K_{O2}$ each time the counted number $N_{IH}$ reaches the predetermined value $N_I$.

Thus, so far as the output of the $O_2$ sensor 14 is maintained at a lean or rich level, the predetermined value $\Delta K$ is added to or subtracted from the correction coefficient $K_{O2}$ in such a direction as to correct the value $K_{O2}$ so as to obtain a desired air-fuel ratio, whenever the number of counted pulses of the TDC signal inputted reaches a predetermined value $N_I$.

Figure 6:
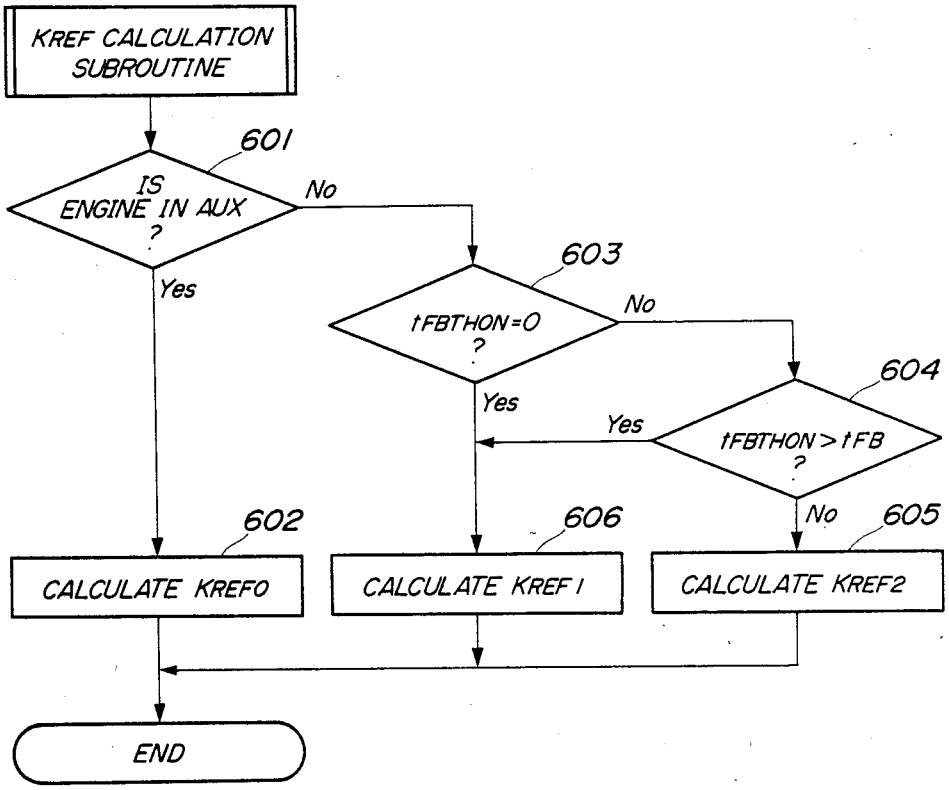
FIG. 6 is a flowchart showing in detail a step 424 in FIG. 4, in which is executed a subroutine for calculation of average values $K_{REF}$ of the correction coefficient $K_{O2}$.

Next, the $K_{REF}$ calculation subroutine carried out at step 424 in FIG. 4 will be described in detail with reference to the flowchart shown in FIG. 6.

First, it is determined at step 601 whether or not the engine is operating in the operating region (I or AUX) of the auxiliary fuel injection valve **6*b* in the present loop. If the answer at step 601 is Yes, the average value $K_{REF0}$ for use in the control in the operating region of the auxiliary fuel injection valve 6*b* is calculated according to the above-described equation (3) (step 602**), followed by terminating the present program.

If the answer at step 601 is No, that is, if in the present loop the engine is operating in the operating region (II or MAIN) of the main fuel injection valve **6*b*, it is determined at step 603 whether or not a counted value $t_{FBTHON}$ of the $t_{FBTHON}$ timer which is reset at step 406 or step 408 and is started at step 410 in FIG. 4 is equal to 0. If the answer at step 603 is No, that is, if the $t_{FBTHON}$ timer is still operating, it is determined at step 604 whether or not the counted value $t_{FBTHON}$ is larger than a predetermine value $t_{FB}$. If the answer at step 604 is No, the average value $K_{REF2}$ is calculated according to the equation (3), followed by terminating the present program. In other words, the average value $K_{REF2}$ is calculated only for the predetermined time period $t_{FB}$ after the engine has shifted from the operating region of the auxiliary fuel injection valve 6*b* to that of the main fuel injection valve 6*a***.

If the answer at step 603 or step 604 is Yes, that is, if the counted value $t_{FBTHON}$ is equal to 0 or larger than the predetermined value $t_{FB}$, the average value $K_{REF1}$ for use in the control in the operating region I of the main fuel injection valve **6*a* is calculated according to the above-described equation (3) (step 606), followed by terminating the present program. In other words, the average value $K_{REF1}$ is calculated only when the engine is operating in the operating region of the main fuel injection valve 6*a***, insofar as the above-mentioned average value $K_{REF2}$ is not being calculated.

What is claimed is:

1. A method of controlling in a feedback manner the air-fuel ratio of an air-fuel mixture being supplied to an internal combustion engine having an intake system, at least one first fuel injection valve and at least one second fuel injection valve both arranged in said intake system for operating in respective different operating regions of the engine, the operating regions including an air-fuel ratio feedback control region, an exhaust system, and sensor means arranged in said exhaust system for sensing the concentration of an exhaust gas ingredient therein, wherein during operation of said engine in said air-fuel ratio feedback control region, the air-fuel ratio is controlled by the use of a coefficient which has an initial value and varies with change in the output of said sensor means, the method comprising the steps of:

(a) determining whether or not the engine is operating in a first operating region falling within said feedback control region, in which said first fuel injection valve is to operate;

(b) determining whether or not the engine is operating in a second operating region falling within said feedback control region, in which said second fuel injection valve is to operate;

(c) calculating an average value of values of said coefficient obtained during past operation of said engine in said first operating region, and storing the resulting average value as a first average value, when it is determined that the engine is operating in said first operating region;

(d) calculating an average value of values of said coefficient obtained during past operation of said engine in said second operating region, and storing the resulting average value as a second average value, when it is determined that the engine is operating in said second operating region;

(e) setting the initial value of said coefficient to a value based on said first average value to thereby start the feedback control of the air-fuel ratio, when the engine has shifted to said first operating region; and (f) setting the initial value of said coefficient to a value based on said second average value to thereby start the feedback control of the air-fuel ratio, when the engine has shifted to said second operating region.

2. A method as claimed in claim 1, wherein said second operating region is an idling region which is part of said air-fuel ratio feedback control region, and said first operating region forms part of said air-fuel ratio feedback control region other than said idling region.

3. A method as claimed in claim 1, wherein said intake system has an intake pipe and a throttle valve arranged in said intake pipe, said first fuel injection valve being arranged in said intake pipe at a location upstream of said throttle valve, and said second fuel injection valve being arranged in said intake pipe at a location downstream of said throttle valve.

4. A method as claimed in claim 1 or claim 3, wherein at said step (f), the initial value of said coefficient is set to the product of said second average value and a predetermined coefficient.

5. A method of controlling in a feedback manner the air-fuel ratio of an air-fuel mixture being supplied to an internal combustion engine having an intake system, at least one first fuel injection valve and at least one second fuel injection valve both arranged in said intake system for operating in respective different operating regions of the engine, the operating regions including an air-fuel ratio feedback control region, an exhaust system, and sensor means arranged in said exhaust system for sensing the concentration of an exhaust gas ingredient therein, wherein during operation of said engine is said air-fuel ratio feedback control region, the air-fuel ratio is controlled by the use of a coefficient which has an initial value and varies with change in the output of said sensor means, the method comprising the steps of:

(a) determining whether or not the engine is operating in a first operating region falling within said feedback control region, in which said first fuel injection valve is to operate;

(b) determining whether or not the engine is operating in a second operating region falling within said feedback control region, in which said second fuel injection valve is to operate;

(c) determining whether or not the engine is operating in a third operating region which is defined as a period of time which elapses after the engine has shifted from said second operating region to said first operating region;

(d) calculating an average value of values of said coefficient obtained during past operation of said engine in said first operating region, and storing the resulting average value as a first average value, when it is determined that the engine is operating in said first operating region;

(e) calculating an average value of values of said coefficient obtained during past operation of said engine in said second operating region, and storing the resulting average value as a second average value, when it is determined that the engine is operating in said second operating region;

(f) calculating an average value of values of said coefficient obtained during past operation of said engine in said third operating region, and storing the resulting average value as a third average value, when it is determined that the engine is operating in said third operating region;

(g) setting the initial value of said coefficient to a value based on said first average value to thereby start the feedback control of the air-fuel ratio, when the engine has shifted from an operating region other than said feedback control region to said first operating region;

(h) setting the initial value of said coefficient to a value based on said second average value to thereby start the feedback control of the air-fuel ratio, when the engine has shifted to said second operation region; and (i) setting the initial value of said coefficient to a value based on said third average value to thereby start the feedback control of the air-fuel ratio, when the engine has shifted to said third operating region.

6. A method as claimed in claim 5, wherein said second operating region is an idling region which is part of said air-fuel ratio feedback control region, and said first operating region forms part of said air-fuel ratio feedback control region other than said idling region.

7. A method as claimed in claim 5 or claim 6, wherein said intake system has an intake pipe and a throttle valve arranged in said intake pipe, said first fuel injection valve being arranged in said intake pipe at a location upstream of said throttle valve, and said second fuel injection valve being arranged in said intake pipe at a location downstream of said throttle valve.

* * * * *